US007069966B2

(12) United States Patent
Kumar

(10) Patent No.: US 7,069,966 B2
(45) Date of Patent: Jul. 4, 2006

(54) LIQUID INJECTOR SYSTEM

(76) Inventor: Neilan K Kumar, 28 Hill-cross Avenue, Morden, London (GB) SM4 4EA ( * ) Notice: Subject to any disclaimer, the term of this patent is extended or adjusted under 35 U.S.C. 154(b) by 149 days.

(21) Appl. No.: 10/475,312

(22) PCT Filed: Apr. 19, 2002

(86) PCT No.: PCT/GB02/01825

§ 371 (c)(1),
(2), (4) Date: Apr. 14, 2004

(87) PCT Pub. No.: WO02/085775

PCT Pub. Date: Oct. 31, 2002

(65) Prior Publication Data

US 2004/0195376 A1 Oct. 7, 2004

(30) Foreign Application Priority Data

Apr. 21, 2001 (GB) ..... 0109876.3

(51) Int. Cl.
*B65B 1/04* (2006.01)

(52) U.S. Cl. ..... 141/100; 141/301

(58) Field of Classification Search ..... 141/67, 141/9, 100, 351, 301; 222/82, 83, 389
See application file for complete search history.

(56) References Cited

U.S. PATENT DOCUMENTS 4,453,651 A 6/1984 Braithwaite et al.
6,158,628 A 12/2000 Englram et al.

FOREIGN PATENT DOCUMENTS

EP 0 384 691 8/1990
WO WO 90/15951 12/1990

*Primary Examiner*—Steven O. Douglas
(74) *Attorney, Agent, or Firm*—Nixon & Vanderhye, P.C.

(57) ABSTRACT

A liquid injector system includes a liquid injector (10) comprising a container (11) for containing a concentrated liquid and having an opening (13) which is closed by a valve (23). The valve (23) is biased to a closed position by leaf springs (28) and is opened by engagement by a nozzle. Pressure is applied to the concentrated liquid by means of a manually operable piston (19) so that, when the valve (23) is in an open position, at least some of the concentrated liquid is dispensed under pressure from the container (11).

18 Claims, 7 Drawing Sheets

LIQUID INJECTOR SYSTEM

This application is the US national phase of international application PCT/GB02/01825 filed Apr. 19, 2002 which designated the U.S.

This invention relates to a liquid injector system and, more particularly, to a hand-held liquid injector system.

In particular, although not exclusively, the present invention has reference to such a system for use in dispensing a concentrated beverage, for example a soft drink concentrate, into a dilutant, e.g. water.

It is known to provide dispensers, for example liquid soap dispensers, having a pump mechanism for releasing liquid contents from a container. However, such hand-held devices do not provide for transfer of liquid from a container in a controlled manner.

According to the present invention, there is provided a hand-held liquid injector system including a liquid injector comprising a container for containing a liquid and having an outlet, a manually operable piston slidable in the container and a valve member for controlling flow of liquid through the outlet from the container, the arrangement being such that operation of the piston causes the liquid to be subjected to pressure whereby, when the valve member is operated, at least some of the liquid is transferred from the container under pressure in a controlled manner.

The system may also include nozzle means for engaging the valve member. The nozzle means may be a separate element which may be releasably accommodated and stored on an external part of the system when not in use. In the alternative the nozzle means may be permanently associated with the valve member. The nozzle means may be integral with a cap device for a second container.

By way of example only various embodiments of a hand-held liquid injector system according to the invention are described below with reference to the accompanying drawings in which.

Figure 10:
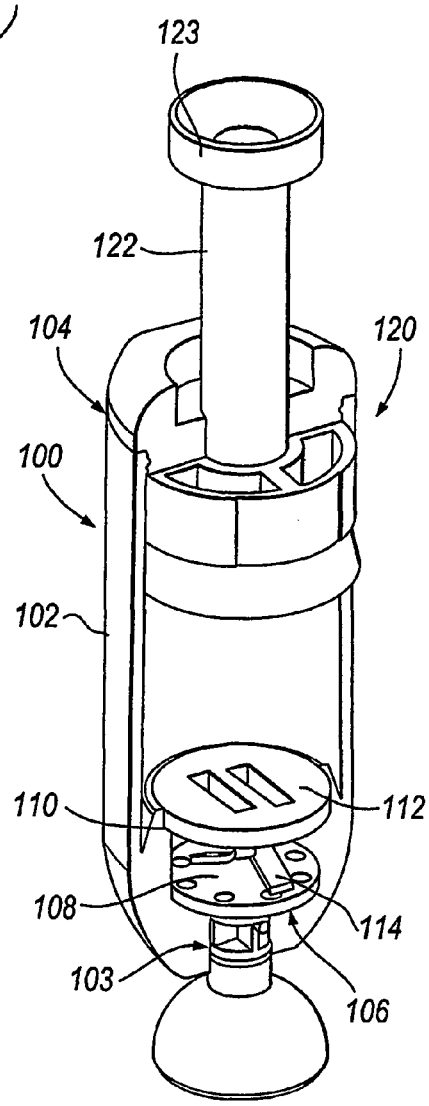
Figure 11:
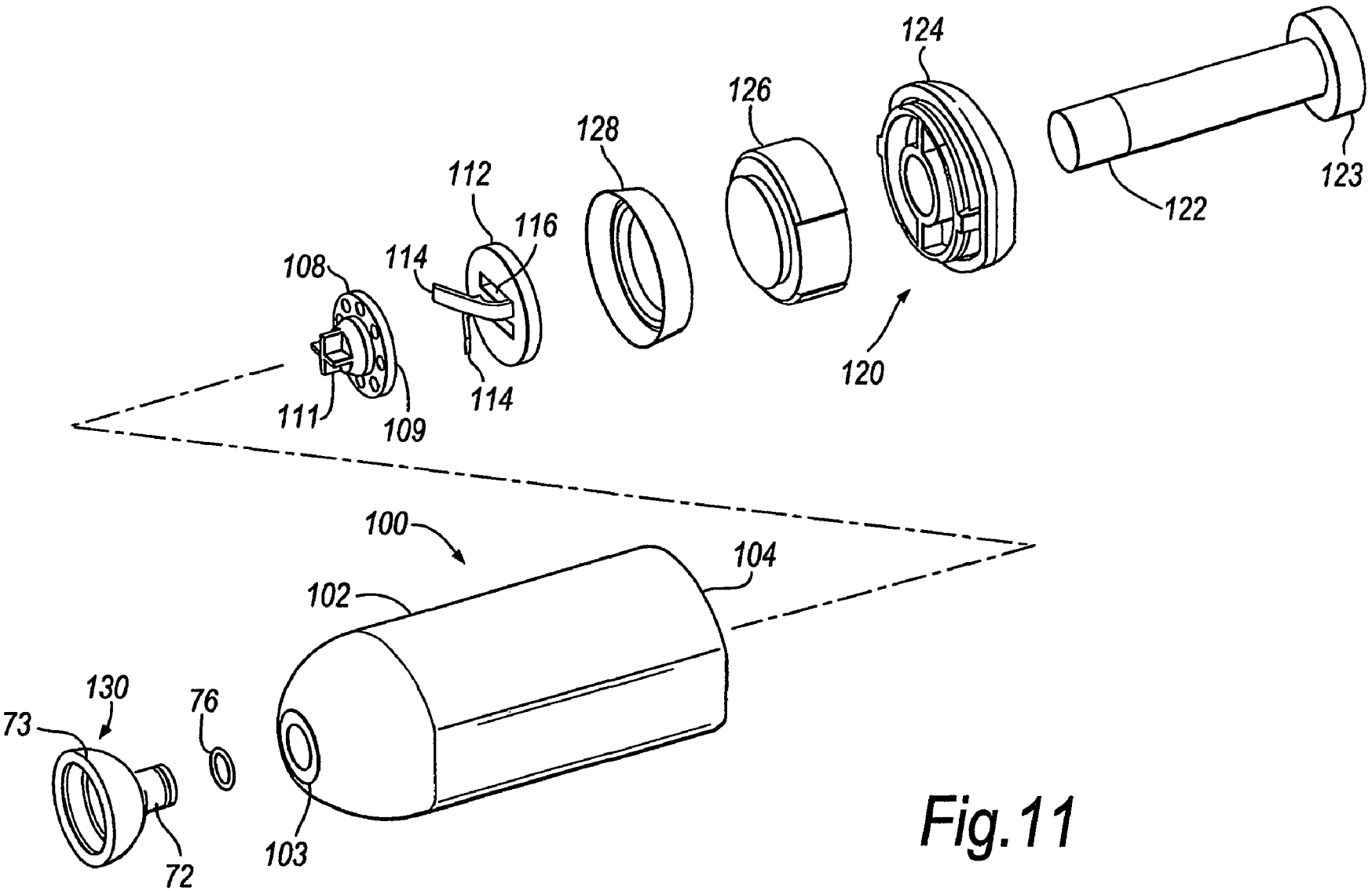

FIG. 10 a partly cut-away view of a third embodiment of liquid injector; and FIG. 11 is an exploded view of the third embodiment shown in FIG. 10.

Referring now to FIGS. 1 to 5 of the drawings, there is shown an injector 10 comprising a cylindrical container 11 which is formed of plastics material, which is open at one end portion thereof and which is formed as a cowl 12 at a remote end portion thereof, the cowl 12 having a rectangular opening 13. The container 11 is provided with a cylindrical liner 14 an end portion of which is turned outwardly to provide a circumferential rim 15 and a remote end portion of which is turned inwardly to provide opposite facing finger-like abutment surfaces 16, inner surfaces of which define an aperture 17 which is located coaxially with a central longitudinal axis of the container 11. The liner 14 is formed of plastics material portions of which are formed as elongate leaf springs 18. The liner 14 is inserted axially into the container 11 through the open end thereof so that the circumferential rim 15 thereof engages an adjacent end wall of the container 11 and lower end portions of the leaf springs 18 extend through the aperture 17.

The liner 14 has received therein a piston 19, one end portion of which is provided with a circumferentially extending rim 20 and a flat end wall 21. An opposite end portion of the piston 19 remote from the end wall 21 is tapered, as shown at 22.

The container 11 has slidably located in the opening 13 thereof a rectangular valve 23 having inlet ports 24 and an outlet port 25, an upper portion of the valve 23 having an outward peripherally extending rim 26. The arrangement is such that in a fully inward position of the valve 23, the valve 23 abuts the abutment surfaces 16 and in a fully outward position of the valve 23, the rim 26 of the valve 23 abuts an inner circumferential margin of the opening 13.

Figure 1:
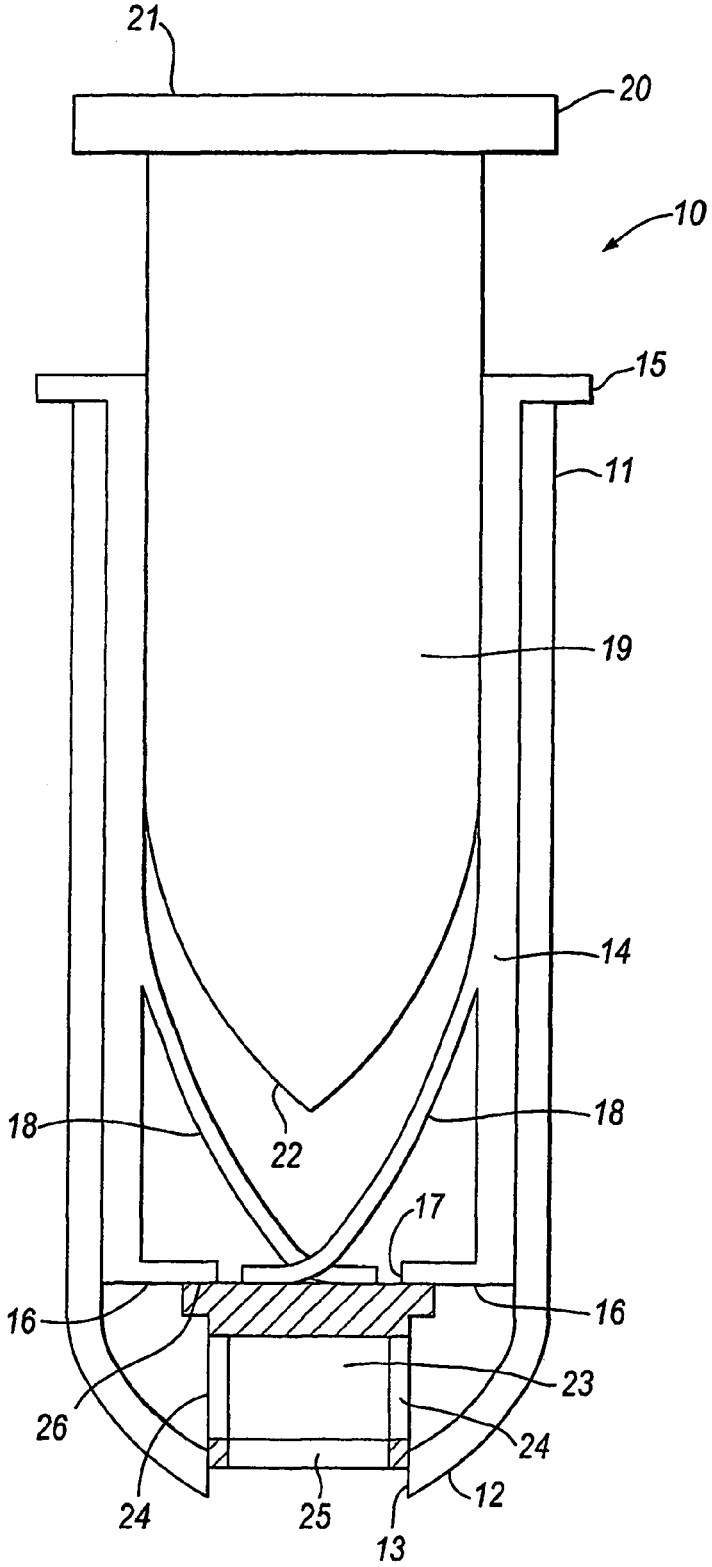
FIG. 1 is a diagrammatic cross section of a first embodiment of a liquid injector of the system.
Figure 2:
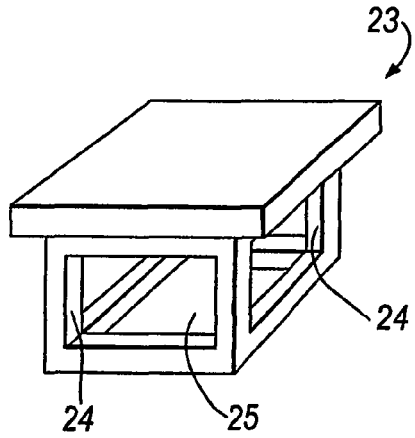
FIG. 2 is a perspective view of a valve member of the injector.

As the valve 23 moves inwardly against the resilient bias of the leaf springs 18 towards the abutment surfaces 16, the leaf springs 18 flex arcuately in opposite directions one to another, as shown in FIG. 1. Also as shown in FIG. 1, the dimensions of the valve 23 are such that, when the valve 23 is in abutment with the abutment surfaces 16, a lower end portion of the valve 23 is located in the opening 13 of the container 11.

Preferably, the liner 14 does not cover the whole of an inner surface of the container 11 and the container 11 is of transparent or translucent material so that contents in the container 11 are visible from outside of the container 11. The container 11 is marked with a longitudinally extending scale (not shown) having gradations indicative of calories.

Figure 3:
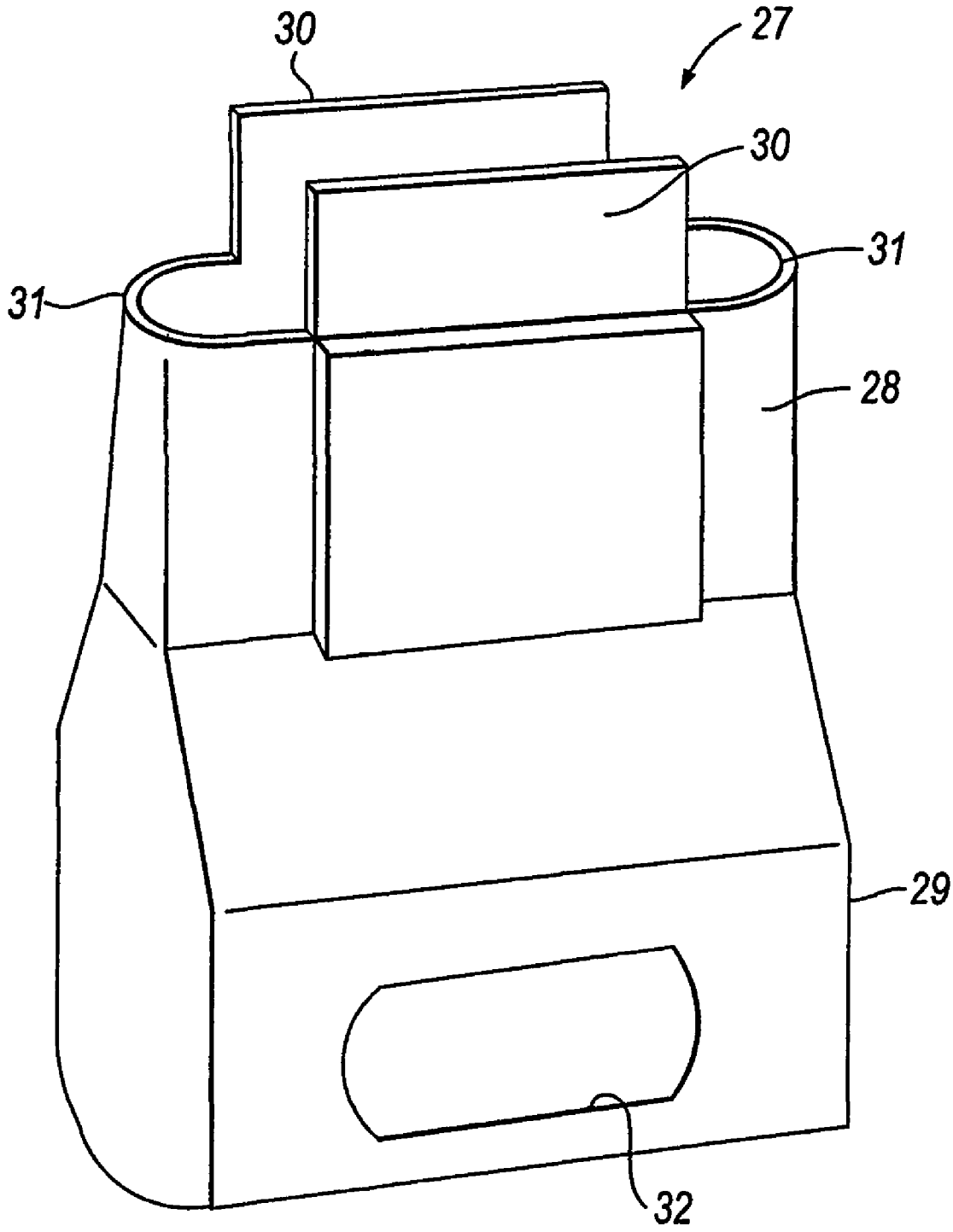
FIG. 3 is a perspective view of a nozzle for operating the valve member.

Referring now to FIG. 3 of the drawings, there is shown a nozzle 27 which is generally of cylindrical configuration having an upper end portion 28 and a lower skirt portion 29. The upper end portion 28 has a pair of upwardly extending spaced parallel projections 30 which are of reduced dimension compared with a corresponding transverse dimension of the upper end portion 28 thereby providing a pair of abutment surfaces 31 adjacent corresponding end portions of the projections 30. The skirt portion 29 is provided with a pair of finger grips, one of which is shown at 32.

Prior to insertion of the piston 19 into the container 11, a concentrated liquid is poured into the container 11.

Figure 4:
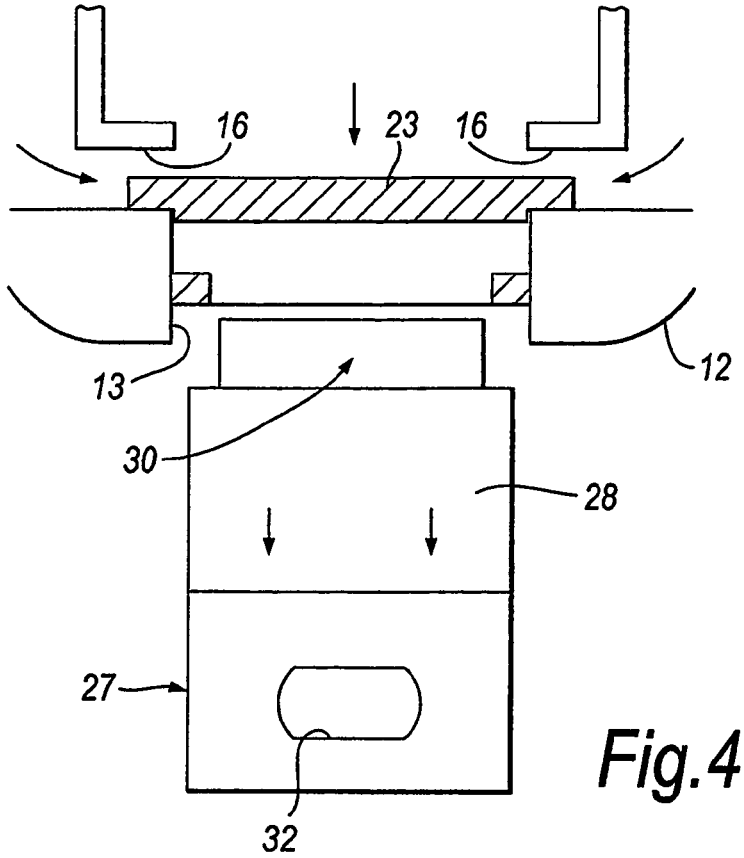
FIG. 4 is a diagrammatic representation showing engagement of the valve member by the nozzle.
Figure 5:
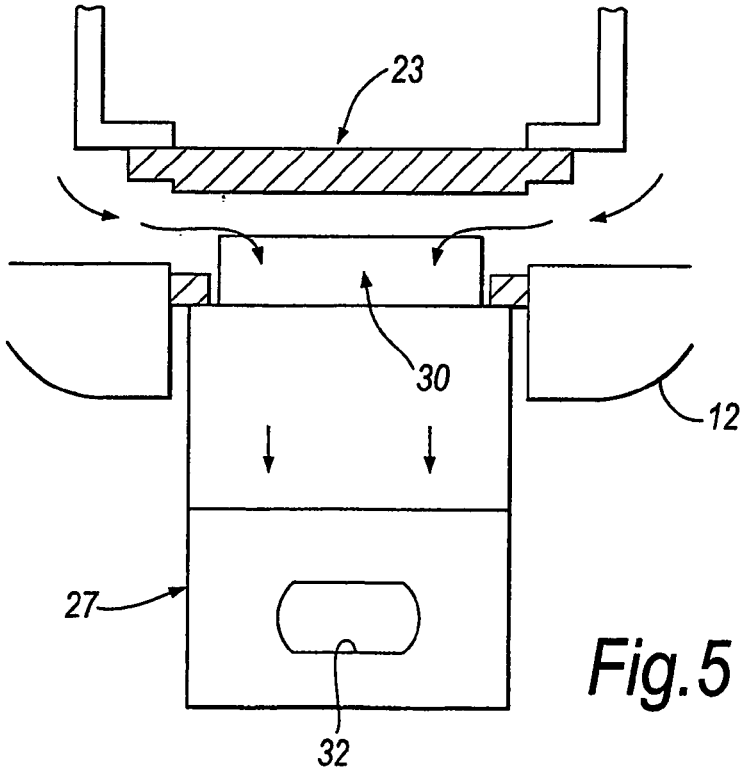
FIG. 5 is a view corresponding to FIG. 4 showing operation of the valve member by engagement of the nozzle.

In use, the concentrated liquid in the container 11 is primed by pressing downwardly on the flat end wall 21 of the piston 19 so as to push the piston 19 into the cylinder 11 and apply downward pressure on the concentrated liquid. The skirt portion 29 of the nozzle 27 is then seated on a cap 33 (see FIG. 6) or a cap 44 (see FIG. 7) which is located on an open neck of a bottle (not shown) containing a liquid which is to receive at least some of the concentrated liquid contained in the container 11. As shown in FIG. 4 the projections 30 of the nozzle 27 are located in the opening 13 of the container 11 such that the projections 30 enter into the outlet port 25 of the valve 23 and the abutment surfaces 31 of the nozzle 27 engage a lower surface of the valve 23. The injector 10 is then moved toward the nozzle 27 thereby effecting relative movement between the injector 10 and the nozzle 27 such that the valve 23 moves inwardly of the container 11 against the bias of the leaf springs 18 and some of the concentrated liquid in the container 11 is forced through the inlet ports 24 and the outlet port 25 of the valve 23 outwardly of the container 11 and into bottle. The amount of concentrated liquid which is transferred is controlled by the pressure applied to the piston 19. After the desired amount has been transferred, the nozzle 27 is removed and the valve 23 is urged by the leaf springs 18 to the closed position. The movement of the piston 19 ensures that transfer of the concentrated liquid is effected in a controlled manner.

It will be appreciated that, as the concentrated liquid is expelled from the container 11, the level of the concentrated liquid in the container 11 lowers relative to the scale providing an indication as to the number of calories which have been transferred to the bottle. The process may be repeated so as to ensure that a required dosage may be transferred in a controlled manner.

An adapter (not shown) may be provided having the same shape as the nozzle 27 but without the lower skirt portion 29. Such an adapter would be for use in operating the injector 10 so as to supply contents of the injector 10 into an open container, such as a cup or a glass.

Figure 6:
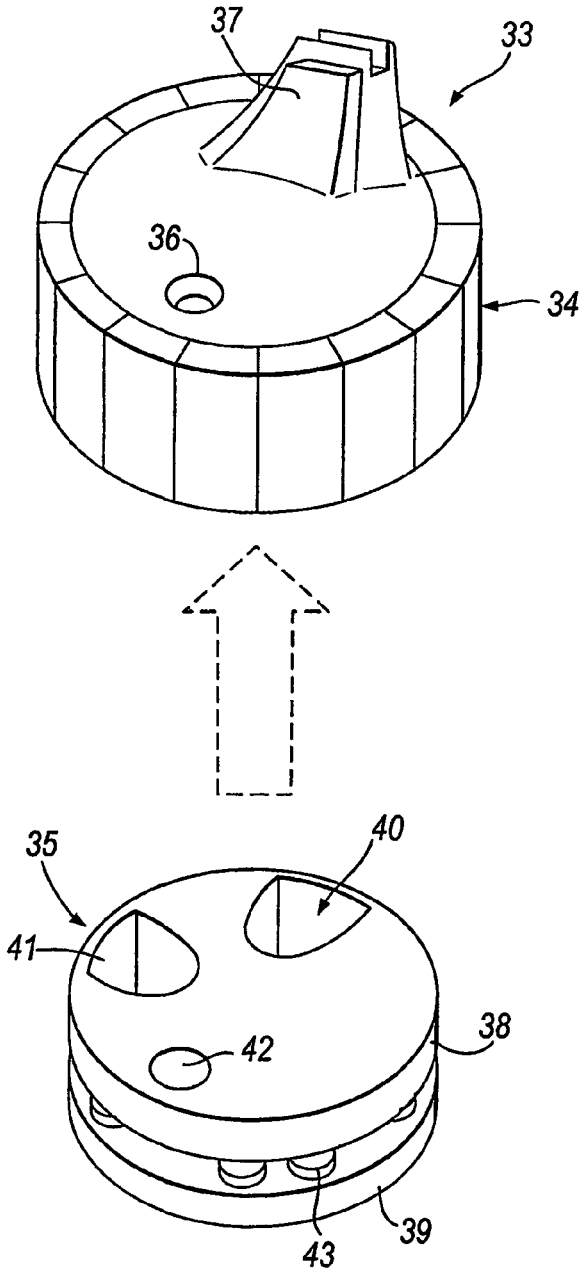
FIG. 6 is an exploded perspective view of a cap for use with the injector.

Referring now to FIG. 6 of the drawings, there is shown a cap 33 for use with the injector 10, the cap comprising two components, being an outer portion 34 and an inner portion 35. The outer portion 34 includes an aperture 36 and a nozzle 37, the latter corresponding to the upper end portion 28 of the nozzle 27.

The inner portion 35 of the cap 33 comprises a pair of discs 38, 39 each of which is provided with a pair of apertures 40, 41, for selectively locating in register with the nozzle 37, and an aperture 42, for locating in register with the aperture 36 in the outer portion 34. The discs 38, 39 are spaced one from another by a centering mechanism 43 and the discs 38, 39 and the centering mechanism 43 are secured one to another forming a single unit. The centering mechanism 43 comprises one of a pair of opposed tracks, the other being located on an inner surface of the outer portion 34 of the cap 33. Each of the tracks comprises a series of undulations and the opposed tracks engage one with another. The arrangement is such that the inner portion 35 is located inside the outer portion 34 of the cap 33 and when the cap 33 is located on an open neck of a bottle, the cap 33 may be turned to an "inject" mode, whereby the aperture 40 is in communication with the nozzle 37 and the aperture 36 of the outer portion 34 is in register with the apertures 42 of the inner portion 35 to provide for displacement of air outwardly from inside of the bottle when the contents from the injector 10 are injected into the bottle or in a "ready to drink" mode whereby the aperture 41 is in communication with the nozzle 37 but the aperture 36 is closed off, or in a "closed" mode whereby the interior of the bottle and the aperture 36 is closed off. The centering mechanism 43 ensures that when the cap 33 is in each of the three modes, communication through the nozzle 37 is either completely open or completely closed off.

The cap 33 may also include a blocking mechanism (not shown) whereby the outer and inner portions 34, 35 of the cap 33 are constrained to rotate together to effect screwing and unscrewing of the cap 33 on the bottle.

Figure 7:
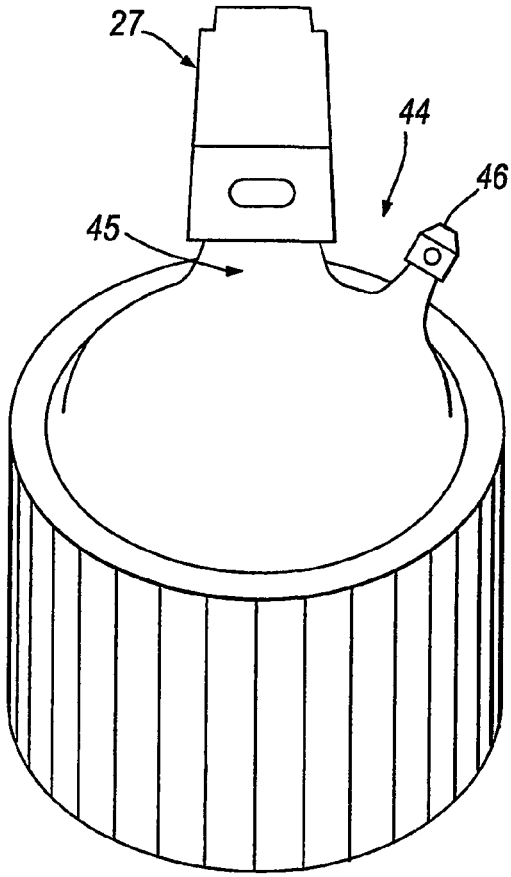
FIG. 7 is a diagrammatic representation of the nozzle shown mounted on a sports cap.

Referring now to FIG. 7 of the drawings, there is shown a sports cap 44 having a mouth piece 45 and a secondary release outlet in the form of an air valve 46. The sports cap 44 may be adapted for co-operation with the injector 10 by locating on the mouth piece 45 the nozzle 27 and effecting co-operation between the injector 10 and the nozzle 27. The air valve 46 may be adjusted to allow for air to be expelled from a bottle having the sports cap 44 attached thereto.

Figure 8:
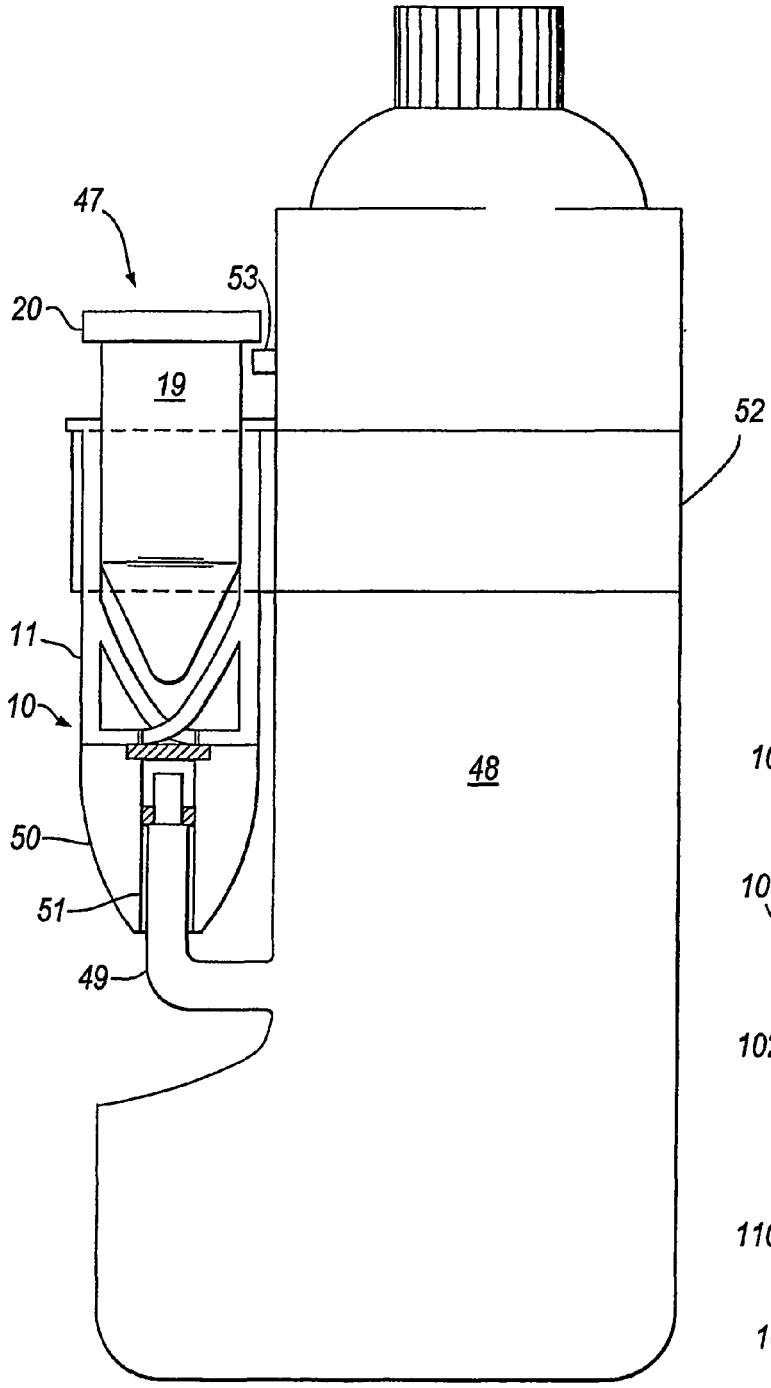
FIG. 8 is an elevation, shown partly in cross section, of the first embodiment of a liquid injector in situ on a further container.

Referring now to FIG. 8 of the drawings, there is shown a liquid injection system 47 in which an injector 10 is combined with a container 48. The container 48 is provided with an inlet tube 49 and the injector 10 is provided with an elongate cowl 50 having a central longitudinal passageway 51 for receiving the inlet tube 49. The container 48 is also provided with a laterally extending abutment 53 which may be of a temporary or permanent nature. The injector 10 is secured to the container 48 by means of a tape 52 which extends circumferentially around the container 48 and the injector 10 such as to permit movement of the container 11 longitudinally thereof relative to the tape 52 to effect operation of the injector 10, the piston 19 being restrained from such movement by engagement of rim 20 of the piston 19 with the abutment 53 of the container 48. The abutment 53 may be temporarily movable to allow the piston 19 to move to pressurise the concentrate and at the same time to move the injector to open the valve to allow concentrate to flow into the container 48. The abutment 53 may then assume its original position. When pressure is released from the injector 10 the valve reseats to close off the flow of concentrate. In the alternative the abutment may be removably by fracture from the container. In a further alternative the abutment may be resilient to the extent that passage of the rim 20 may displace it temporarily for the purpose of piston movement and may then resume its original position by virtue of its resilience. In a variation of the embodiment shown in this figure, the tape 52 may be replaced by a collar secured to or integral with the container 48, the injector 10 being insertable therethrough in the manner of a cartridge to register with the inlet tube 49.

Figure 9:
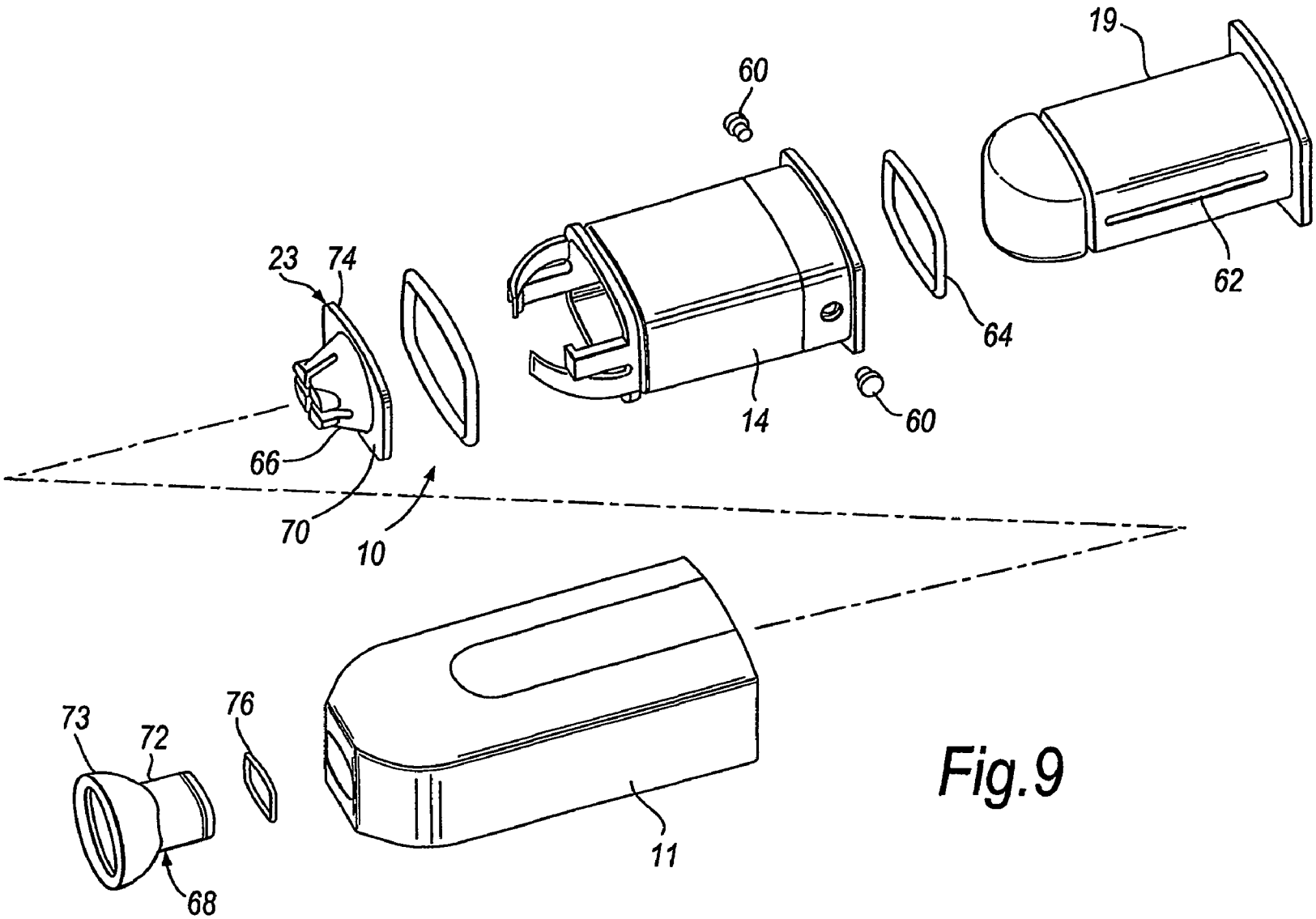
FIG. 9 is an exploded view of a second embodiment of liquid injector similar to the first embodiment.

Referring now to FIG. 9 the second embodiment of liquid injector is shown and as will be appreciated is very similar to the first embodiment and like numerals of reference have been employed for like parts. The injector 10 is of generally rectangular cross section and it will be noted that the liner 14 is provided with plunger retainer pins 60 which in the assembled mode register with slots 62 on the side of the piston 19 thereby to define the stroke thereof to ensure that the piston cannot inadvertently be removed from the liner. A seal 64 is provided at the relatively upper end of the liner such that when the piston is located therewithin a positive seal is formed to prevent ingress of extraneous matter and the egress of liquid held within the container 11.

The valve 23 of this embodiment is of slightly different shape than in the first embodiment in terms of the abutment 66 which is adapted for engagement by a nozzle means in the form of an adapter 68. A valve sealing surface 70 is formed on the underside of the valve plate 74 supermounting the abutment 66. The sealing surface 70 in the closed position of the valve 23 seats on a land (not shown) formed internally and circumferentially of the opening 13 of the container.

The adapter 68 has a first substantially rectilinear tubular portion 72 leading to a flared skirt portion 73 which is so shaped as to locate over a bottle top, for example a sports cap provided with a conventional pop-up valve arrangement. A seal 76 is provided for the portion 72 as shown such that when inserted within the opening 13 sealing is effected to prevent leakage. The flared skirt portion 73 has an opening which itself is provided with a seal (not shown) whereby when in position on a bottle cap an effected seal is provided to ensure that during discharge of the concentrate into the bottle substantially no leakage occurs. The operation of the second embodiment is identical to that of the first embodiment whereby discharge of the concentrate is effected by a combination of the opening of the valve 23 and the operation of the piston 19. Once a sufficient amount of the contents from the container has been discharged into the receptor bottle, the adapter 68 is withdrawn from the opening 13 and the valve 23 resumes its closed position under the action of the leaf springs 18.

Referring now to FIGS. 10 and 11 a third embodiment of liquid injector is provided as shown generally at 100 and has a container 102 of cylindrical form having an outlet 103 for the discharge in use of the contents from the container and an inlet end 104. A valve seat 106 is formed circumjacent the outlet 103 and a valve member 108 is adapted for sealing engagement therewith in its closed position (seen in FIG. 10). The valve member 108 has an apertured head 109 for engagement with the seat 106 and an abutment portion 111 of cruciform shape.

Disposed in spaced relation from the valve seat 106 is a land 110 within the container 102 and seated on this land is a perforated disc 112 provided with leaf spring fingers 114 depending therefrom to engage in use the valve member 108. The perforations 116 may be so created that the material for the perforations so removed forms the spring fingers 114 as in this embodiment. The spring fingers 114 are limited in their movement and at the end of their depression by the valve constitute a stop therefor.

A plunger 120 comprises a handle 122 with a recessed head 123, the plunger extending through a cap 124 for the top of the container 102 and the cap being suitably held by screw fitment or frictional engagement with said top. The handle has fixed on its relatively inner end a plunger head 126 provided with a cupped sealing washer 128 which engages in resilient and sweeping manner the interior of the container as can be seen in FIG. 10.

A nozzle means in the form of an adapter 130 is shown and is of similar form to that (68) of the second embodiment save that the first portion in this embodiment is of tubular cylindrical shape; accordingly the adapter will not be described again but like numerals of reference to those applied in relation to FIG. 9 are employed on the FIGS. 10 and 11. In this embodiment however, the adapter 130 may be accommodated and releasably held within the recessed head 123 of the plunger handle when not in use.

In operation the container 102 is charged with a concentrate in liquid form through the inlet 104 prior to the insertion of the plunger 120, the liquid at that stage being prevented from leaving the container by virtue of the valve 108 being held in a closed position against the seat 106 by the spring fingers 114. In the alternative the concentrate can be introduced through the outlet past the valve 108 once it is lifted off its seat.

The plunger 120 is then inserted into the container 102 and the cap 124 is closed onto the top of the container as shown in FIG. 10. Pressure is applied to the plunger to prime the liquid in the container and the liquid injector is ready for use. In this respect, the adapter 130 is removed from its parked position in the recessed head of the plunger handle and the flared skirt portion 74 of the adapter is fixed over a bottle cap, for example a sports cap (not shown). The first portion 72 is then inserted through the outlet 104 and abuts the valve abutment to lift the valve off its seat 106 thereby to allow the discharge of the liquid from the container. The liquid effectively flows through the apertured head 109 of the valve into the first portion 72 and the flared portion and thence into the bottle cap and into the bottle. The duration of valve lift to effect discharge of the concentrate is determined by the user and thus any volume of liquid can be ejected according to demand, the injector being re-usable in this regard.

Once the required dosage has been discharged from the injector, the container is removed from the bottle cap and the spring fingers act to reseat the valve and effect closure of the container thereby preventing egress of its contents.

It is to be appreciated that the adapter in the form of nozzle means may be permanently disposed in the outlet of the container and thus irremovable therefrom. In the alternative as in the case of the third embodiment the adapter may during non-use be releasably held in the recessed head of the plunger handle or elsewhere on the container wherever is most convenient.

In other embodiments incorporating the present invention the injector may be integral with another container with the valve being actuable by any suitable means externally of the container of the injector; for example a button or lever could extend into the lower part of the injector to contact the valve and be operable to lift it off its seat to allow passage of the concentrate directly into the other container.

It is to be understood that the container may also be used for the discharge of its contents into a receptacle other than a bottle. In this respect the adapter merely needs to be inserted in the outlet of the container and then pressed to actuate the valve into its open position thus allowing discharge into the receptacle.

The resilient bias on the valve may be of any convenient form and whilst it has been principally described herein as comprising the leaf spring type, the bias may be constituted by an open coil compression spring or by an elastomeric material or any suitable equivalent thereof.

The present invention is intended primarily but not solely for use as a cartridge for dispensing a concentrated soft drink for dilution in water or another beverage which could be a soft drink itself or an alcoholic beverage.

The invention claimed is:

1. A hand-held liquid injector system comprising a liquid injector, the liquid injector comprising a container for containing a liquid having an outlet, a manually operable piston slidable in the container and a valve member movable into and out of a closed portion for controlling flow of the liquid through the outlet from the container, the injector being arranged such that operation of the piston causes the liquid to be subjected to pressure whereby, when the valve member is operated, at least some of the liquid is transferred from the container under pressure in a controlled manner, the injector further comprising a stopper for limiting movement of the valve member inwards away from the closed position.

2. A system as claimed in claim 1 wherein the valve member is operable against a resilient bias.

3. A system as claimed in claim 2 wherein the resilient bias is effected by at least one leaf spring.

4. A system as claimed in claim 3 wherein the leaf spring and the stopper are integral one with another.

5. A system as claimed in claim 1 further comprising a nozzle for engaging the valve member.

6. A system as claimed in claim 5 further comprising a cap device for a second container, wherein the nozzle is integral with the cap device.

7. A system as claimed in claim 5 wherein the nozzle is a separate element.

8. A system as claimed in claim 7 wherein the nozzle is stowable on the container when not in use.

9. A system as claimed in claim 5 wherein the nozzle is integrated within the outlet of the container.

10. A system as claimed in claim 6 further comprising a second cap device having a plurality of apertures, wherein the cap device is adapted to co-operate with the second cap device, and the cap device and the second cap device are moveable relative one to another so that the apertures are selectively locatable relative to the nozzle.

11. A system as claimed in claim 10 further comprising means for adjusting relative movement of the cap device and the second cap device so that, when a said aperture is selectively located relative to the nozzle, the aperture is centered relative to the nozzle.

12. A system as claimed in claim 1 further comprising a second container for receiving liquid from the injector, wherein the liquid injector is combined with the second container.

13. A system as claimed in claim 1 further comprising a cap for a second container, the cap having a secondary release outlet.

14. A system as claimed in claim 13 wherein the secondary release outlet is in the form of a valve mechanism.

15. A system as claimed in claim 5 further comprising a cap for a second container wherein the cap comprises a mouthpiece on which the nozzle can be located.

16. A hand-held liquid injector system comprising a liquid injector, the liquid injector comprising a container for containing a liquid having an outlet, a manually operable piston slidable in the container and a valve member for controlling flow of the liquid through the outlet from the container, the injector being arranged such that operation of the piston causes the liquid to be subjected to pressure whereby, when the valve member is operated, at least some of the liquid is transferred from the container under pressure in a controlled manner, the injector further comprising a stopper for limiting movement of the valve member, the system further comprising a nozzle for engaging the valve member.

17. A hand-held liquid injector system comprising a liquid injector, the liquid injector comprising a container for containing a liquid having an outlet, a manually operable piston slidable in the container and a valve member for controlling flow of the liquid through the outlet from the container, the injector being arranged such that operation of the piston causes the liquid to be subjected to pressure whereby, when the valve member is operated, at least some of the liquid is transferred from the container under pressure in a controlled manner, the injector further comprising a stopper for limiting movement of the valve member, the system further comprising a second container for receiving liquid from the injector wherein the liquid injector is combined with the second container.

18. A hand-held liquid injector systems comprising a liquid injector, the liquid injector comprising a container for containing a liquid having an outlet, a manually operable piston slidable in the container and a valve member for controlling flow of the liquid through the outlet from the container, the injector being arranged such that operation of the piston causes the liquid to be subjected to pressure whereby, when the valve member is operated, at least some of the liquid is transferred from the container under pressure in a controlled manner, the injector further comprising a stopper for limiting movement of the valve member, the system further comprising a cap for a second container, the cap having a secondary release outlet.

* * * * *